US005403207A

United States Patent [19]

Briones

[11] Patent Number: 5,403,207

[45] Date of Patent: Apr. 4, 1995

[54] ELECTRICAL CONNECTOR WITH ELECTRICAL COMPONENT MOUNTING STRUCTURE

[75] Inventor: Francisco R. Briones, Markham, Canada

[73] Assignee: Amphenol Corporation, Wallingford, Conn.

[21] Appl. No.: 41,466

[22] Filed: Apr. 2, 1993

[51] Int. Cl.[6] ..... H01R 13/66

[52] U.S. Cl. ..... 439/620; 439/79; 439/676

[58] Field of Search ..... 439/620, 676, 607, 79

[56] References Cited

U.S. PATENT DOCUMENTS

| | | | |
|---|---|---|---|
| 4,695,115 | 9/1987 | Talend | 439/620 X |
| 4,799,901 | 1/1989 | Pirc | 439/620 |
| 4,806,117 | 2/1989 | Johnston | 439/344 |
| 4,904,209 | 2/1990 | Nelson | 439/676 |
| 5,069,641 | 12/1991 | Sakamoto et al. | 439/620 |
| 5,219,305 | 6/1993 | Kawaguchi et al. | 439/620 |
| 5,282,759 | 2/1994 | Sakamoto et al. | 439/620 |

FOREIGN PATENT DOCUMENTS 3612416 10/1987 Germany .

*Primary Examiner*—Eugene F. Desmond
*Attorney, Agent, or Firm*—Bacon & Thomas

[57] ABSTRACT

An electrical connector includes a main body and a separate electrical component retention member which meet at an interface. The connector contacts are positioned in grooves ending in enlarged areas for receiving terminals of an electrical component such as a transformer. The component extends rearwardly from the interface and is retained in an opening in the retention member and the retention member is press fit onto the rear of the main body portion to removably hold the component in plane and align the component with corresponding contacts of the connector.

22 Claims, 2 Drawing Sheets

ELECTRICAL CONNECTOR WITH ELECTRICAL COMPONENT MOUNTING STRUCTURE

BACKGROUND OF THE INVENTION

1. Field of the Invention

This invention relates to an electrical connector.

2. Description of Related Art

The present invention addresses the problem of fitting components onto an interface card or circuit board, for example a local area network (LAN) adapter. In order to address this problem, the present invention provides a structure which may be utilized in a variety of applications, and is not limited to LAN adapters or connectors mounted on circuit boards.

Typically, a LAN adapter requires a transformer, mounted on an interface board, for transferring data from a main data bus to the interface board, and a connector on the board through which signals are transferred from the data bus to the transformer. The present invention proposes to combine the transformer with the connector to both save space and provide a more efficient arrangement. It is particularly suitable for use in a telephone jack-type connector, but not limited thereto.

The illustrated embodiment of the invention uses a known type of surface mount transformer, an example of which is marketed by TDK under the designation CIT-35 SERIES, and which has a footprint of approximately 5.5 mm×9 mm and a height of approximately 5 mm. While this conventional transformer is smaller than a typical telephone jack type connector used in LAN applications, its structure is nevertheless too big to be accommodated within the typical connector. Furthermore, present techniques for surface mounting such a transformer on a circuit board would be unreasonably difficult and expensive for use in a connector, even if space in the connector could be found.

SUMMARY OF THE INVENTION

It is accordingly an objective of the invention to provide an electrical connector which includes a transformer or other relatively large electrical component.

It is a further objective of the invention to provide an electrical connector in which a transformer or other electrical component is removably retained without the need for soldering or other fixing means, and which is self-aligning, thereby simplifying assembly and reducing cost.

These objectives are accomplished, according to a preferred embodiment of the invention, by providing an electrical connector which includes a main body in which the electrical connector contacts are housed and a discrete rear component retention member for supporting and positioning the electrical component, the electrical component being electrically connected to the contacts at an interface between the main body and the retention member. The preferred connector includes slots shaped to position the contacts, the slots having enlarged openings in which are fit terminals of the electrical component in order to align the terminals with the contacts and establish an electrical connection between the contacts and the component. In the case where the electrical component is a transformer, the contacts include separate upper and lower contact portions with the transformer bridging a space between the contact portions, thereby providing an in-line transformer connection. In an especially advantageous embodiment of the invention, the component is held within the rear insert portion of the connector while the electrical connection is established by press-fitting the rear insert portion onto the main body portion.

DETAILED DESCRIPTION OF THE PREFERRED EMBODIMENTS

Figure 1:
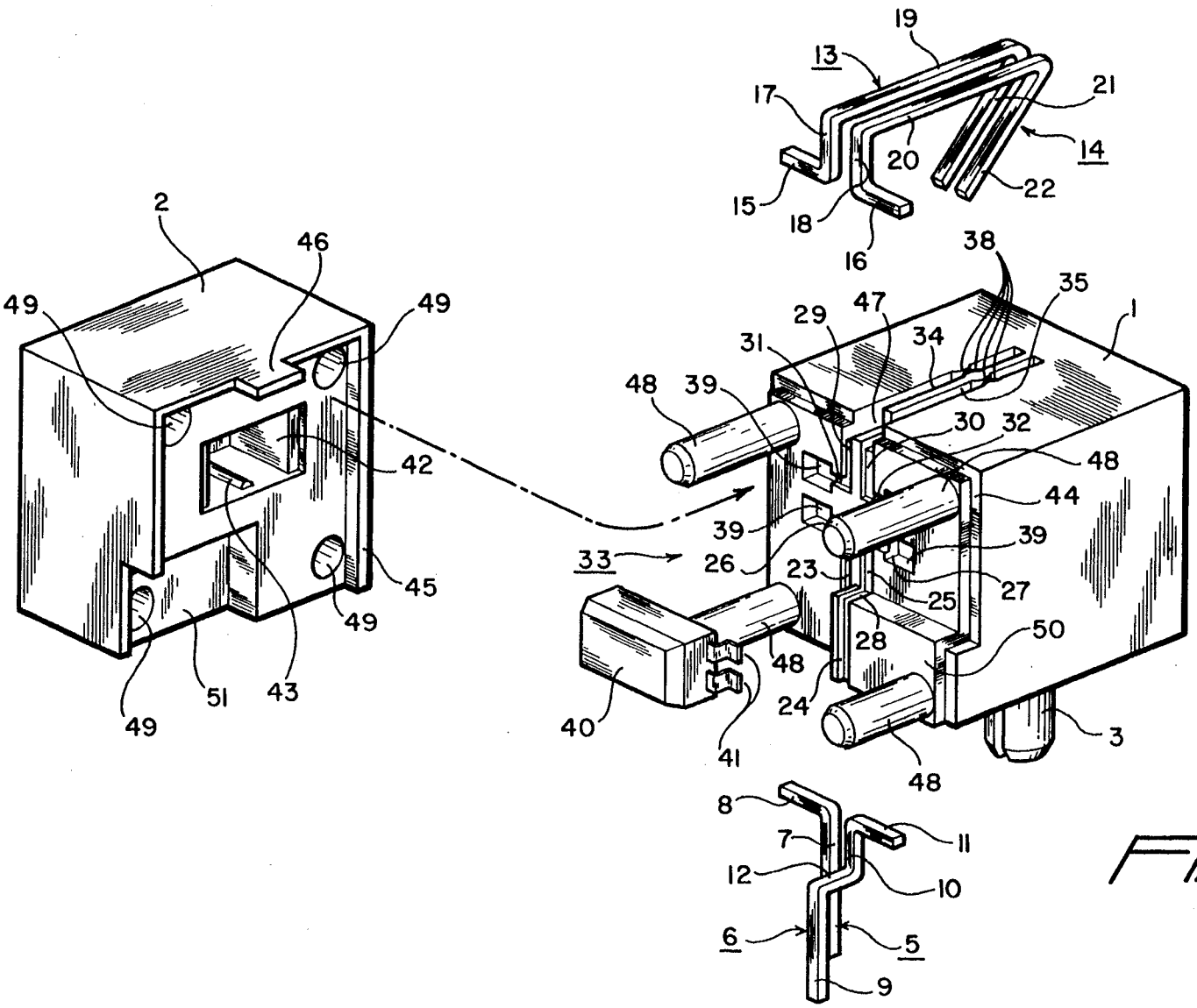
FIG. 1 is a perspective view showing each of the components of an electrical connector constructed in accordance with the principles of a preferred embodiment of the invention, before assembly of the rear section of the connector to its main body.
Figure 2:
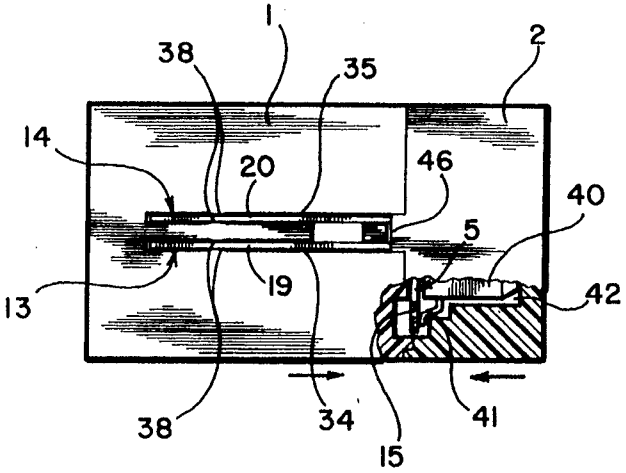
FIG. 2 is a top view, partially in cross-section, of an assembled connector constructed in accordance with the principles of the embodiment of FIG. 1.
Figure 5:
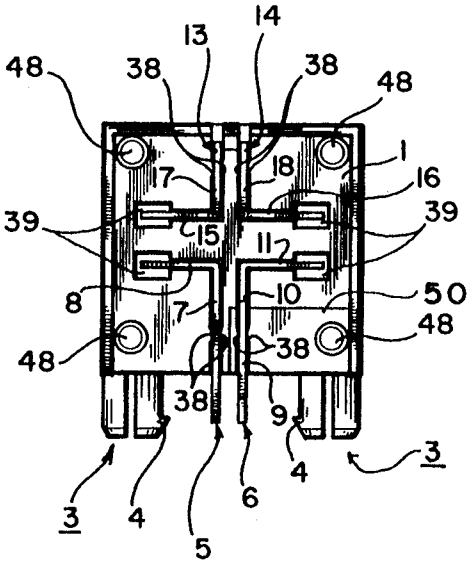
FIG. 5 is a rear elevation showing an interface portion of the connector of FIG. 2, before assembly of the component to the connector.
Figure 4:
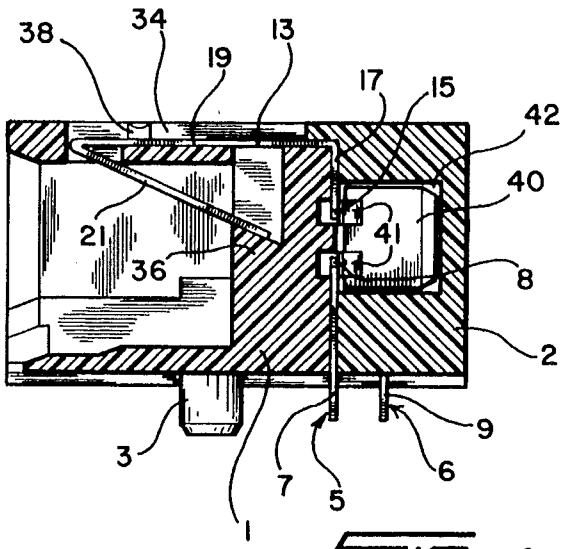
FIG. 4 is a cross-sectional side view of the connector of FIG. 2.
Figure 3:
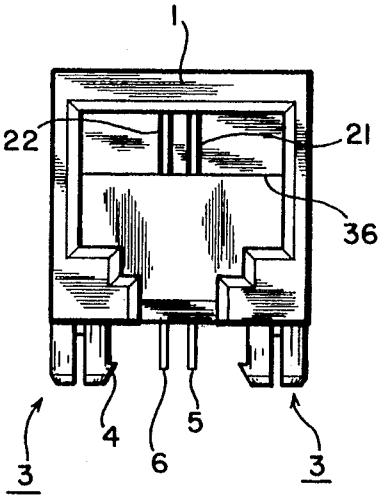
FIG. 3 is a front elevation of the connector of FIG. 2.

As shown in the figures, the preferred embodiment of the invention is an electrical connector which includes a main body portion 1 and a component retention member 2. Main body portion 1 in the illustrated embodiment is arranged to be mounted on a circuit board (not shown) and therefore includes split mounting posts 3 with extensions 4 for securing the main body portion to the circuit board, the separation between the tines of each post permitting the post to flex as the main body portion is inserted into a hole in the main circuit board until extension 4 on each post clears the hole.

Also provided on the circuit board are traces to which a pair of board contacts 5 and 6 are electrically connected. Board contact 5 has an L-shape and is made up of a vertical portion 7 and a transverse portion 8, the vertical portion extending from the lower face of the main body portion 1 so as to fit within a hole in the circuit board when assembled to the main body portion. Board contact 6 includes two vertical portions 9 and 10, vertical portion 9 also extending below the main body portion so as to be insertable into a hole in the circuit board, and a transverse portion 11 which corresponds to transverse portion 8 of board contact 5. Connecting vertical portions 9 and 10 is another transverse portion 12, which is perpendicular to transverse portion 11 and to the vertical portions 9 and 10.

The board contacts 5 and 6 form part of an input circuit to the circuit board, the input circuit being completed by one winding of a transformer 40, a second winding of the transformer 40 being electrically connected to contacts 13 and 14. Contacts 13 and 14 are identical and are respectively made up of transverse portions 15 and 16 which correspond to portions 8 and 11 of the board contacts, vertical portions 17 and 18, horizontal portions 19 and 20 perpendicular to both the vertical portions 17 and 18 and the transverse portions 15 and 16, and inclined portions 21 and 22 which are arranged to contact corresponding contacts on a standard plug connector (not shown) which is inserted into the main body portion.

To position the contacts, main body 1 includes vertically extending grooves 23–25 which correspond, respectively, to board contact portions 7, 9, and 10, horizontally extending grooves 26–28 which correspond to board contact portions 8, 11, and 12, vertical portions 29 and 30, corresponding to vertical portions 17 and 18 of contacts 13 and 14, and horizontal portions 31 and 32 corresponding, respectively, to transverse portions 15 and 16. Grooves 26–32 are located on the rear face of main body 1, which forms an interface portion 33 of the main body. Extending along the top surface of main body 1 are grooves 34 and 35, which accommodate portions 19 and 20 of contacts 13 and 14, while the ends of portions 21 and 22 of contacts 13 and 14 are supported by a shelf 36 in the interior of body 1 in known fashion. Each of grooves 26–32, 34, and 35 may optionally include detents 38 for helping to secure the contacts therein.

The purpose of dividing the contacts into two sets of contacts 5, 6 and 13, 14 is, as suggested above, to enable transformer 40 to be connected to the contacts so that board contacts 5 and 6 are connected together by a first coil of the transformer and contacts 13 and 14 are connected together by a second coil of the transformer, thus enabling signals to be transmitted between the sets of contacts while at the same time isolating the contacts from each other. Each of grooves 26, 27, 31 and 32 includes a terminal mounting portion 39 consisting of an enlarged groove area shaped to fit the terminals 41 of transformer 40 which, in the illustrated example, is a miniature transformer of the type available from TDK Company of Japan under the designation CIT-35 SERIES, IEEE 802.3. This type of transformer is commonly used in LAN applications in which it is surface mounted to the LAN board. The transformer includes two pairs of terminals 41 extending from ends thereof which fit within enlarged groove areas 39 on the connector, such that the component body extends to the rear of the main body 1 when the terminals contact the respective transverse portions 8, 11, 15, and 16 of the contacts to establish electrical connection therewith.

In order to secure the transformer 40 in position to electrically connect together the board contacts 5 and 6 and contacts 13 and 14, a separate component retention member 2 is provided. Retention member 2 includes an opening 42 sufficiently large to accommodate the main body of component 40, but also including means for causing an interference fit between the transforming body and the opening. These means are preferably in the form of, for example, ridges 43 which will accommodate tolerances in the dimensions of the component body itself. The purpose behind the placement of opening 42 is to align the component such that when the retention member 2 is aligned with and assembled to main body portion 1, terminals 41 of the transformer 40 will be aligned with openings 39 and therefore with the appropriate contacts 5, 6, 13, and 14.

Alignment of the retention member 2 and main body portion 1 is provided in the illustrated embodiment by an indent or notch 44 which extends around the periphery of the interface between the retention member and the main body 1, and a corresponding flange 45 on the retention insert portion 2. Flange 45 includes a tab 46 which fits within an opening 47 in the top of the main body 1.

Alignment is also provided by the press fit arrangement made up of pegs 48 on the main body portion 1 and corresponding holes 49 in the retention insert portion 2, the dimensions of the holes being sufficiently small to provide an interference fit between the pegs and the walls of the holes in order to thereby secure retention member 2 to main body 1, causing terminals 41 of transformer 40 to engage portions 8, 11, 15, and 16 which are positioned in openings 39.

In order to ensure proper alignment between the various components of the preferred connector and avoid damage when assembling retention member 2 in the main body 1 to the main body portion 1, a polarizing feature is provided by including a projecting area 50 and a corresponding indentation 51 in the retention member. For LAN applications, the circuit board holes are generally staggered such that one of the contacts must extend behind the other contact, and thus the polarizing feature utilizes this conventional feature so that the width of the projection 50 is exactly the width by which contact 6 would extend behind contact 5 in a conventional connector of this type. In addition, a polarizing effect is obtained by extending the notch 44 and flange 45 around only three sides of, respectively, the main body portion 1 and the rotation member 2.

Having described in detail a specific preferred embodiment of the invention, it will be appreciated by those skilled in the art that many of the features of the preferred embodiment may be varied without departing from the scope of the invention. For example, any projections provided on the main body, such as pegs 48, may alternatively be provided on the insert, and vice versa. The means by which the insert is secured to the main body may be latch rather than a simple interference fit, and of course the principles of the invention may be extended to contact configurations involving more than 2 contacts, with the shape of the contacts and the grooves varied accordingly. The interface and indentations on the insert may be shaped to accommodate a variety of different electrical components, including transformers of different shapes and sizes, and the preferred component mounting arrangement may be used in types of connectors other than the connector illustrated, including shielded and/or filtered connectors.

These and other variations which will occur to those skilled in the art are all intended to be included within the scope of the invention, and consequently those skilled in the art will appreciate that the above description should be read as being by way of example only, and that the invention should be limited solely in accordance with the appended claims.

What is claimed is:

1. An electrical connector, comprising:

a main body including means for receiving a mating connector such that contacts of said mating connector engage contacts positioned in said main body;

means for positioning said contacts in said main body;

means including a component retention member discrete and separable from said main body for holding the component during assembly;

means in said retention member for retaining an electrical component having at least two terminals;

means for aligning and securing said retention member on said main body such that said electrical component is positioned with respect to said contacts so that terminals of said electrical component engage respective ones of said contacts as the retention member is secured to said main body, thereby connecting said contacts to each other through said electrical component, wherein said means for retaining the component in said retention member comprises means defining an opening in said retention member into which said component is interference fit.

2. A connector as claimed in claim 1, wherein said means for aligning and securing said retention member on said main body includes pegs extending from said main body and means defining openings in said retention member for receiving said pegs in an interference fit.

3. A connector as claimed in claim 1, wherein a number of said contacts is two.

4. An electrical connector, comprising:

a main body including means for receiving a mating connector such that contacts of said mating connector engage contacts positioned in said main body means for positioning said contacts in said main body;

means including a component retention member discrete and separable from said main body for holding the component during assembly;

means in said retention member for retaining an electrical component having at least two terminals;

means for aligning and securing said retention member on said main body such that said electrical component is positioned with respect to said contacts so that terminals of said electrical component engage respective ones of said contacts as the retention member is secured to said main body, thereby connecting said contacts to each other through said electrical component, wherein said means for retaining the component in said retention member comprises means defining an opening in said retention member into which said component is interference fit, and wherein said means for aligning and securing said retention member on said main body further includes a flange extending around three sides of a periphery of said retention member and a notch extending around three sides of a periphery of said main body.

5. A connector as claimed in claims 1 or 4, wherein said means for aligning and securing said retention member on said main body further comprise means defining a projection extending from said main body and an indentation in said retention member.

6. A connector as claims in claims 1 or 4, wherein said means for positioning said contacts in said main body include grooves in which said contacts are positioned and means defining portions of said grooves which are shaped to receive terminals of said electrical component.

7. A connector as claimed in claims 1 or 4, further comprising board contacts separate from said first contacts, said board contacts arranged to be electrically connected to traces on a printed circuit board.

8. A connector as claimed in claim 7, wherein said connector is a telephone jack connector.

9. A connector as claimed in claim 7, wherein said means for positioning said contacts in said main body include means defining first vertically extending grooves in an interface portion of said main body for receiving vertical portions of said first contacts, and means defining second vertically extending grooves in said interface portion for receiving vertical portions of said board contacts.

10. A connector as claimed in claim 9, further comprising means defining transverse grooves which intersect said first and second vertical grooves for receiving transverse portions of said respective main and board contacts.

11. A connector as claimed in claim 10, wherein said means for defining transverse grooves include means for defining enlarged openings for receiving terminals of said electrical component.

12. A contact structure for an electrical connector, comprising:

a pair of board contacts, one of which is L-shaped and the other of which includes a vertical portion arranged to be received in a hole in a circuit board, a horizontal portion extending transversely to said vertical portion, a second vertical portion extending transversely to said horizontal portion, and a second horizontal portion extending transversely to both said vertical portions and said first horizontal portion; and a pair of main contacts, each of which includes a transverse portion extending horizontally, a vertical portion extending transversely to the horizontal portion, a second horizontal portion extending transversely to both said vertical and horizontal portions, and an inclined portion extending at an acute angle relative to said horizontal portions.

13. An electrical connector, comprising:

a plurality of main electrical contacts each including means for engaging electrical contacts on a mating connector;

a plurality of board contacts each including means for establishing an electrical connection with traces on a circuit board;

means including a transformer for transmitting signals from said main electrical contacts to said board contacts;

a main body on which said main electrical contacts and said board contacts are positioned;

means including a retention member for positioning said transformer relative to said main and board contacts and for causing terminals on said transformer to engage said main and board contacts upon securing of said retention member to said main body; and means defining an opening in said retention member into which said transformer is interference fit.

14. A connector as claimed in claim 13, further comprising pegs extending from said main body and means defining openings in said retention member for receiving said pegs in an interference fit.

15. A connector as claimed in claim 13, further comprising means including mounting posts for mounting said connector on a printed circuit board.

16. A connector as claimed in claim 13, further comprising means defining first vertically extending grooves in an interface portion of said main body for receiving vertical portions of said main contacts, and means defining second vertically extending grooves in said interface portion for receiving vertical portions of said board contacts.

17. A connector as claimed in claim 16, further comprising means defining transverse grooves which intersect said first and second vertical grooves for receiving transverse portions of said respective main and board contacts.

18. A connector as claimed in claim 17, wherein said means for defining transverse grooves include means for defining enlarged openings for receiving terminals of said transformer.

19. An electrical connector, comprising:

a plurality of main electrical contacts each including means for engaging electrical contacts on a mating connector;

a plurality of board contacts each including means for establishing an electrical connection with traces on a circuit board;

means including a transformer for transmitting signals from said main electrical contacts to said board contacts;

a main body On which said main electrical contacts and said board contacts are positioned;

means including a retention member for positioning said transformer relative to said main and board contacts and for causing terminals on said transformer to engage said main and board contacts upon securing of said retention member to said main body; and further comprising a flange extending around three sides of a periphery of said retention member and notch extending around three sides of a periphery of said main body.

20. A connector as claimed in claims 13 or 19, further comprising means defining a projection extending from an interface portion of said main body and an indentation in said retention member for aligning said retention member with said main body.

21. A connector as claims in claims 13 or 19, further comprising means defining grooves in said main body for receiving and positioning said main and board contacts.

22. A connector as claimed in claim 21, wherein said means defining grooves in said main body further comprise means for defining openings for receiving terminals of said transformer.

* * * * *